US008214217B2

(12) United States Patent
Conkie

(10) Patent No.: US 8,214,217 B2
(45) **Date of Patent: *Jul. 3, 2012**

(54) SYSTEM AND METHOD FOR PERFORMING SPEECH SYNTHESIS WITH A CACHE OF PHONEME SEQUENCES

(75) Inventor: Alistair D. Conkie, Morristown, NJ (US)

(73) Assignee: AT & T Intellectual Property II, L.P., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/182,082

(22) Filed: Jul. 13, 2011

(65) Prior Publication Data

US 2012/0010877 A1 Jan. 12, 2012

Related U.S. Application Data

(63) Continuation of application No. 11/836,423, filed on Aug. 9, 2007, now Pat. No. 7,983,919.

(51) Int. Cl.
*G10L 13/08* (2006.01)

(52) U.S. Cl. ..... 704/260

(58) Field of Classification Search ..... 704/258–269
See application file for complete search history.

(56) References Cited

U.S. PATENT DOCUMENTS

| | | | | |
|---|---|---|---|---|
| 6,823,307 | B1 | 11/2004 | Steinbiss et al. | |
| 7,983,919 | B2 * | 7/2011 | Conkie | 704/260 |
| 2002/0103646 | A1 | 8/2002 | Kochanski et al. | |
| 2009/0076819 | A1 | 3/2009 | Wouters et al. | |

* cited by examiner

*Primary Examiner* — Abul Azad

(57) ABSTRACT

Disclosed are systems, methods, and computer readable media for performing speech synthesis. The method embodiment comprises applying a first part of a speech synthesizer to a text corpus to obtain a plurality of phoneme sequences, the first part of the speech synthesizer only identifying possible phoneme sequences, for each of the obtained plurality of phoneme sequences, identifying joins that would be calculated to synthesize each of the plurality of respective phoneme sequences, and adding the identified joins to a cache for use in speech synthesis.

20 Claims, 2 Drawing Sheets

SYSTEM AND METHOD FOR PERFORMING SPEECH SYNTHESIS WITH A CACHE OF PHONEME SEQUENCES

PRIORITY INFORMATION

Background of the Invention

1. Field of the Invention

The present invention relates generally to speech synthesis and more specifically to caching join costs for commonly used phoneme sequences for use in speech synthesis.

2. Introduction

Currently, unit selection speech synthesis is performed by selecting and concatenating appropriate acoustic units from a large audio database. Unit selection speech synthesis can be computationally expensive because there are so many possible combinations to consider in real-time calculations. Join cost calculations are among the most frequently performed operations. In order to solve the problem of expensive join cost calculations, many in the art have tried to cache join cost calculations, but combinatorics (specifically permutations with repetition) make the number of join cost calculations prohibitively large. As a reminder, the phrase permutation with repetition represents mathematical combinations where order matters and an item can be used more than once. Permutation with repetition is mathematically represented by the equation $N^R$ where N is the number of objects you can choose from and R is the number to be chosen. As an example, consider a modest estimate of roughly 60 possible phonemes for N. R is the number of phonemes in a given word. The possible permutations are immense. For synthesis of a particular word consisting of a sequence of 5 sounds, if we consider that there are 30 examples of each required sound in the database that could potentially be chosen, then $30^5$, or approximately 24 million, possible outcomes exist. For a word consisting of a sequence of 6 sounds, just one sound more, then $30^6$ possible outcomes exist, skyrocketing the possible outcomes to over 700 million.

The BMR approach, as represented in U.S. Pat. No. 7,082,396, tries to minimize the cache of join cost calculations by only caching "winning" joins which represent the best path through a network for at least one sentence in a text database. The BMR approach is generally successful, but is limited because it requires a lengthy training process and as the number of units in the cache increases, the yield from the process decreases. If the front end changes, substantial retraining may be necessary to add the new material in the front end. Accordingly, what is needed in the art is a method of performing speech synthesis by making a synthesis-independent way to generate a manageable cache of join costs for phoneme sequences.

SUMMARY OF THE INVENTION

Additional features and advantages of the invention will be set forth in the description which follows, and in part will be obvious from the description, or may be learned by practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth herein.

Disclosed herein are systems, methods, and computer readable media for performing speech synthesis. An exemplary method embodiment of the invention comprises applying a first part of a speech synthesizer to a text corpus to obtain a plurality of phoneme sequences, the first part of the speech synthesizer only identifying possible phoneme sequences, for each of the obtained plurality of phoneme sequences, identifying joins that would be calculated to synthesize each of the plurality of respective phoneme sequences, and adding the identified joins to a cache for use in speech synthesis.

The principles of the invention may be utilized to provide, for example in a speech synthesis environment, more rapid development of join caches of the same quality, with more flexibility without retraining the cache, and with potentially more sophisticated join cost calculations. In this manner, as caches of phoneme sequences are populated, speech synthesis systems can be more agile and be adapted more quickly to various needs while requiring less real-time computer capacity.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

Figure 1:
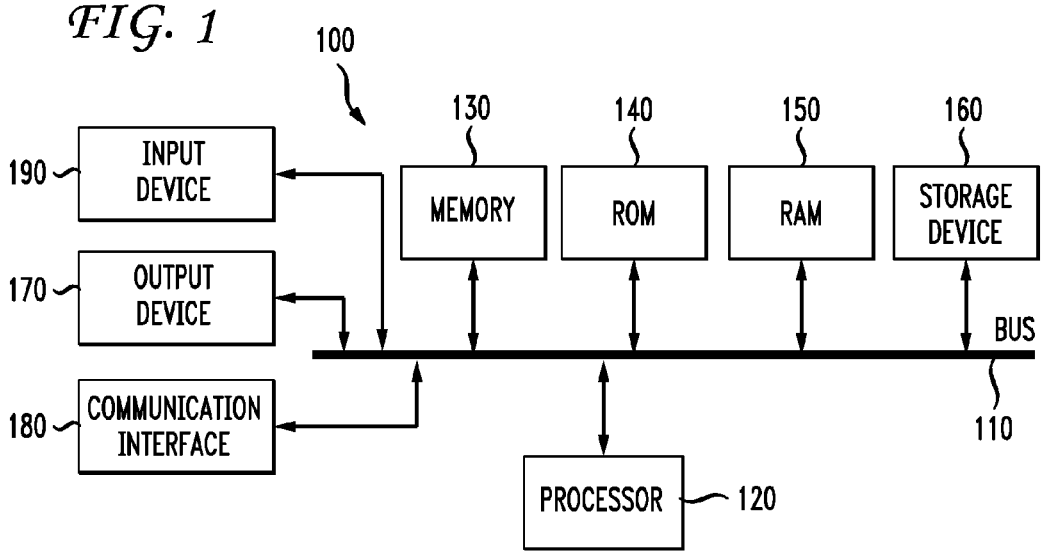
FIG. 1 illustrates a basic system or computing device embodiment of the invention.

With reference to FIG. 1, an exemplary system for implementing the invention includes a general-purpose computing device 100, including a processing unit (CPU) 120 and a system bus 110 that couples various system components including the system memory such as read only memory (ROM) 140 and random access memory (RAM) 150 to the processing unit 120. Other system memory 130 may be available for use as well. It can be appreciated that the invention may operate on a computing device with more than one CPU 120 or on a group or cluster of computing devices networked together to provide greater processing capability. The system bus 110 may be any of several types of bus structures including a memory bus or memory controller, a peripheral bus, and a local bus using any of a variety of bus architectures. A basic input/output (BIOS), containing the basic routine that helps to transfer information between elements within the computing device 100, such as during start-up, is typically stored in ROM 140. The computing device 100 further includes storage means such as a hard disk drive 160, a magnetic disk drive, an optical disk drive, tape drive or the like. The storage device 160 is connected to the system bus 110 by a drive interface. The drives and the associated computer readable media provide nonvolatile storage of computer readable instructions, data structures, program modules and other data for the computing device 100. The basic components are known to those of skill in the art and appropriate variations are contemplated depending on the type of device, such as whether the device is a small, handheld computing device, a desktop computer, or a computer server.

Although the exemplary environment described herein employs the hard disk, it should be appreciated by those skilled in the art that other types of computer readable media which can store data that are accessible by a computer, such as magnetic cassettes, flash memory cards, digital versatile disks, cartridges, random access memories (RAMs), read only memory (ROM), a cable or wireless signal containing a bit stream and the like, may also be used in the exemplary operating environment.

To enable user interaction with the computing device 100, an input device 190 represents any number of input mechanisms, such as a microphone for speech, a touch sensitive screen for gesture or graphical input, keyboard, mouse, motion input, speech and so forth. The input may be used by the presenter to indicate the beginning of a speech search query. The device output 170 can also be one or more of a number of output means. In some instances, multimodal systems enable a user to provide multiple types of input to communicate with the computing device 100. The communications interface 180 generally governs and manages the user input and system output. There is no restriction on the invention operating on any particular hardware arrangement and therefore the basic features here may easily be substituted for improved hardware or firmware arrangements as they are developed.

For clarity of explanation, the illustrative embodiment of the present invention is presented as comprising individual functional blocks (including functional blocks labeled as a "processor"). The functions these blocks represent may be provided through the use of either shared or dedicated hardware, including, but not limited to, hardware capable of executing software. For example the functions of one or more processors presented in FIG. 1 may be provided by a single shared processor or multiple processors. (Use of the term "processor" should not be construed to refer exclusively to hardware capable of executing software.) Illustrative embodiments may comprise microprocessor and/or digital signal processor (DSP) hardware, read-only memory (ROM) for storing software performing the operations discussed below, and random access memory (RAM) for storing results. Very large scale integration (VLSI) hardware embodiments, as well as custom VLSI circuitry in combination with a general purpose DSP circuit, may also be provided.

Figure 2:
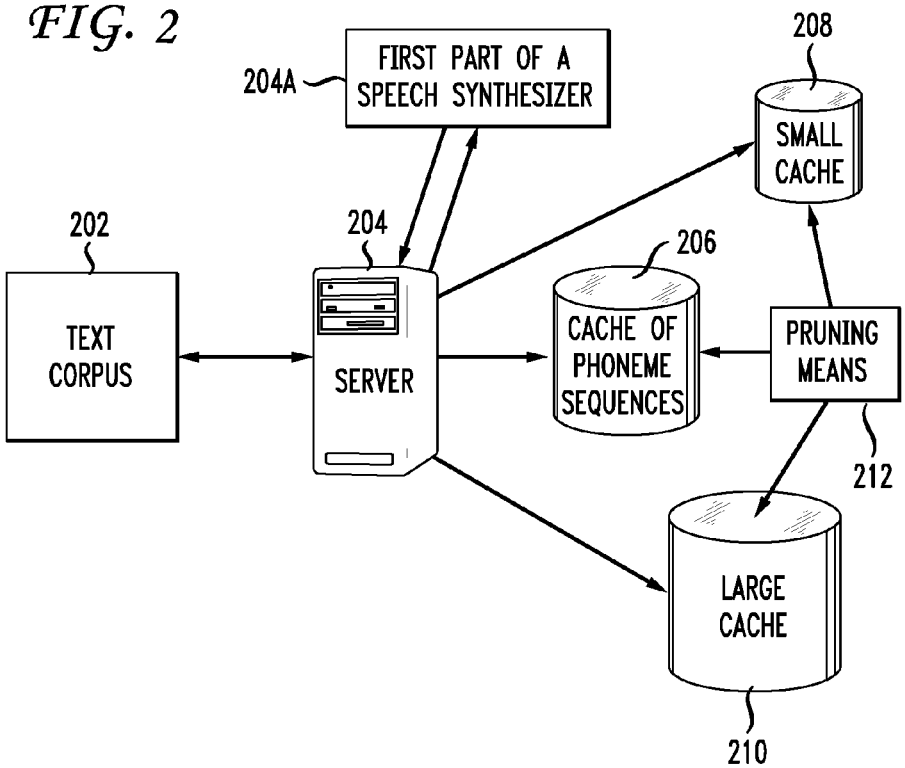
FIG. 2 illustrates an example system for building join caches.

The present invention relates to speech synthesis employing a cache of join costs for phoneme sequences obtained by running a corpus of text through a first part of a speech synthesizer, which only identifies possible phoneme sequences. One preferred example and an application in which the present invention may be applied relates to generating a cache of join costs to be used during speech synthesis. FIG. 2 illustrates a basic example of a server 204 which receives a text corpus 202. The text corpus could include phrases and words likely to be encountered in the anticipated use. The applicability of the results coming from the server may be influenced by the text corpus, if unusual or rare phoneme combinations are expected, such as specific scientific terminology or unusual proper names. Generally, as long as the text corpus comprises typical words and phrases, certain phoneme sequences will naturally occur more frequently because of the constraints of English grammar and English word structure.

Join cost is a term in the art describing how well two selected phoneme units join together. In practice, phoneme units may include phonemes, half phones, diphones, demisyllables, or syllables, although phonemes are discussed for the sake of simplicity and clarity. Target cost is a term in the art describing how close a selected phoneme unit is to the desired phoneme unit. Calculating join cost and target cost (particularly join costs) can be very computationally expensive because of the sheer number of possible combinations. The server addresses this problem by determining which phoneme sequences actually occur in a given text corpus rather than precalculating every possible phoneme sequence join cost. The server may employ more sophisticated algorithms to match the best phoneme joins at a lower join cost and target cost than traditional systems because the text corpus is analyzed beforehand instead of being analyzed on the fly. In a server that must compute join costs on the fly, algorithms are typically optimized for speed instead of accuracy, leading to speech synthesis that may not sound completely natural. Precalculated systems that cache phoneme sequences that actually occur in spoken English have the luxury of using more thorough algorithms capable of making the optimal selection using a Viterbi search or other means, leading to speech synthesis that can more closely approximate human speech.

When the server receives the text corpus, the text is applied to a first part of a speech synthesizer 204A which identifies possible phoneme sequences. The server places the phoneme sequences that actually occur in the cache of phoneme sequences 206. The naïve approach would be to cache every possible combination of phoneme joins, but there are simply too many. This approach of analyzing a text corpus creates a cache of dramatically reduced size with only a minimal decrease in coverage because certain combinations are impossible or unlikely to occur in English. For example, in DARPABET format (examples of which can be found at http://www.ldc.upenn.edu/Catalog/docs/LDC2005s22/darpabet.txt), the sound sequence /zh/ /zh/ (as in the highly contrived "beige gendarme") is extremely rare in English while the sequence /dh/ /ax/ (as in the word "the") is extremely common. Because the sequence /dh/ /ax/ is commonly encountered, join costs and target costs for /dh/ and /ax/ will almost certainly be included in the text corpus. In this way, linguistics naturally constrains the number of possible joins to a much more manageable number. In permutations with repetition which represent English, lowering the possible N or R even by a small number can significantly lower the possible combinations. For example, with roughly 50 possible phonemes for N and a sequence of 5 phonemes, $50^5$ generates over 310,000,000 possible permutations. If 50 phonemes can be reduced to 25 through linguistic constraints that naturally limit the first part of the speech synthesizer, $25^5$ generates a much more manageable 9,700,000 possible permutations. Of course, linguistics constrains the actual permutations that occur in speech, so the actual benefit is usually enhanced.

Any join between two phonemes in the abstract means that when speech signals are used there are 50×50 possible joins to calculate. If there were only two phonemes to consider then the problem would be tractable, but it turns out that context also has an influence and increases overall the number of joins calculations that have to be done for the same two phonemes in order to cover all possible cases. However, the limited number of possible contexts, a consequence of which sound sequences are allowed (in English or any other language) mean that the numbers are smaller than naïve calculations may suggest.

As another example, returning to the importance of the text corpus, if there are unusual combinations in the text corpus, they may be included in the cache in anticipation of their use in an automated telephone menu system or other similar application. Unusual joins could include /s/ /v/ word initially as in svelte (a borrowed foreign word) or as mentioned before /zh /zh/ as in beige gendarme.

In different implementations, a range of computing and storage capacities may be available, limiting the size of the cache. Accordingly, different cache sizes could be generated by the server. A small cache 208 and a large cache 210 are examples of other possible cache sizes. As an example, in a third world country where advanced computer processors are difficult to obtain, a larger cache may be favorable to reduce required computing time. As another example, in a small business where one server handles many different jobs, disk space or memory may be a precious commodity, so a smaller cache may be favorable to conserve storage space.

Choices to use different cache sizes could be influenced by the tradeoffs between accuracy, computational time, and natural-sounding speech synthesis. As an example, perhaps using the top 50% of the phoneme sequences would cover 90% of actual speech, while the top 25% would cover 70% of speech. The tradeoff of slightly more computational power may be worth decreasing the size of the cache.

The speech synthesis system may also store a record in each cache of how many times a specific phoneme join occurs. A pruning means 212 could periodically examine one or more caches and remove one or more items that occur least frequently. As an example, if a particular phoneme is only used 1 time and all others are used more than 40 times, the least used phoneme may be removed from the database without significantly increasing computing requirements or significantly decreasing quality.

The threshold for determining what is pruned and what is not may be set statically or dynamically. An example of a dynamically set threshold for pruning is a server that uses an Intel Core 2 Duo E6600 CPU with 4 megabytes of on-CPU memory. Significant performance benefits might be obtained if the cache of join costs fits entirely in on-CPU memory, so the pruning means could be instructed to maintain the cache within a 4 megabyte limit and if the server changes CPUs to a chip with a larger on-CPU memory, the cache size could be raised. As an example of a statically set threshold for pruning, the pruning means may be instructed to arbitrarily remove any entry from the cache that is not used at least 3 times.

One potential use the method embodiment of this invention may be as a direct replacement for the current BMR join cache as it should be possible to get up and running more quickly in a production environment with the same quality. A second benefit over BMR is flexibility. BMR is currently tailored to a specific front end, and if the front end changes, the system is not optimal and significant retraining is recommended. With this invention, individual phoneme joins are cached which means flexibility and independence from a particular text corpus because the components of the speech are stored, not entire words. This method may also be used as a faster way of training BMR, particularly as step 1 of a 2-step process.

Figure 3:
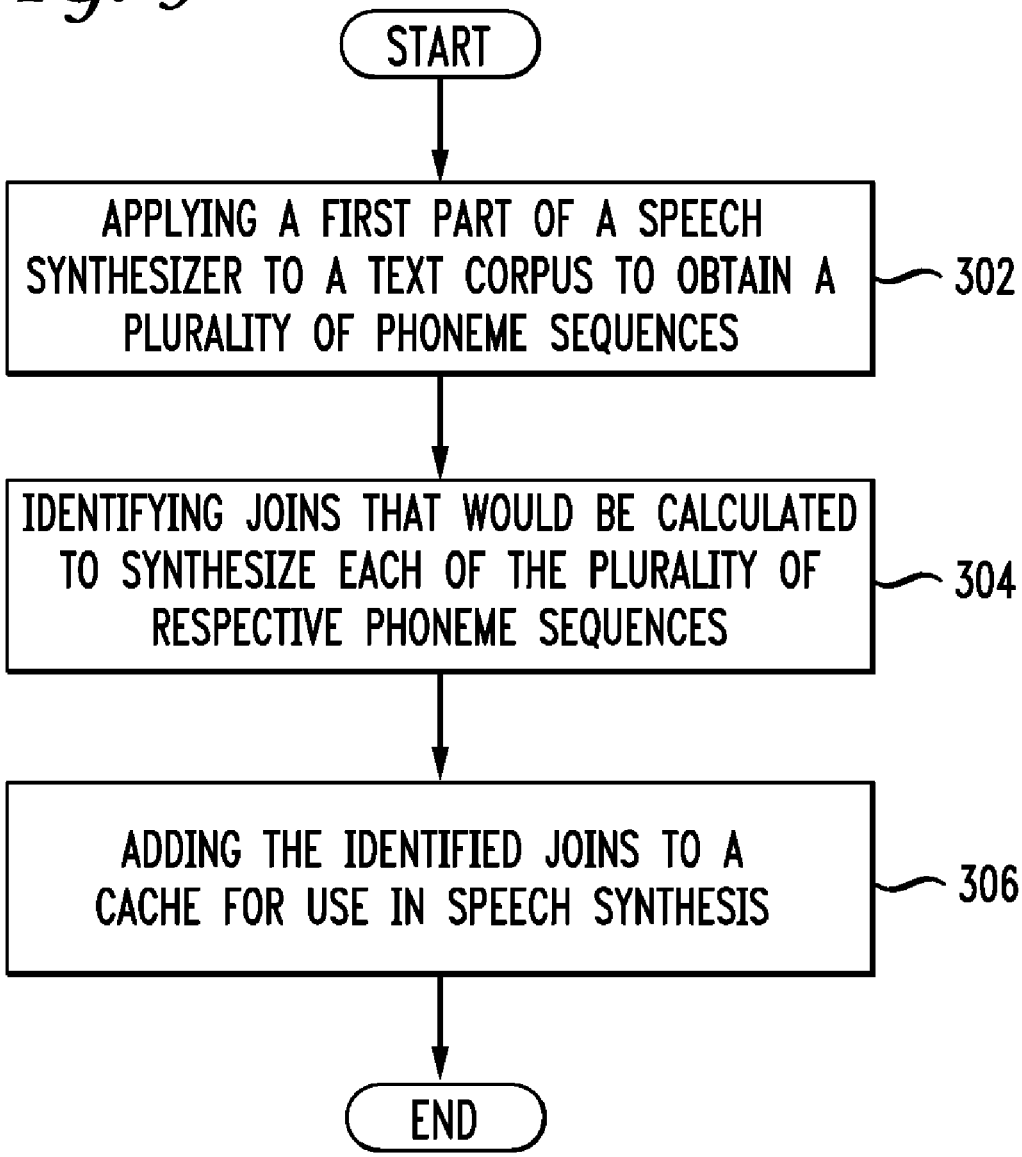
FIG. 3 illustrates a method embodiment of the invention.

FIG. 3 illustrates a method of performing speech synthesis. The method comprises applying a first part of a speech synthesizer to a text corpus to obtain a plurality of phoneme sequences, the first part of the speech synthesizer only identifying possible phoneme sequences (302). As long as the text corpus is representative of commonly spoken English, the possible phoneme sequences should be adaptable to nearly any use. The speech synthesis system does not need to be optimized for speed, as do real-time speech synthesizers. This speech synthesis system can precalculate the computationally expensive join costs and target costs to select the optimal phoneme sequences. Next, the method comprises identifying joins that would be calculated to synthesize each of the plurality of respective phoneme sequences for each of the obtained plurality of phoneme sequences (304). Joins that actually occur in speech are far fewer than those that are mathematically possible. Identifying joins that actually occur can reduce the overall number of joins. Last, the method comprises adding the identified joins to a cache for use in speech synthesis (306). As described above, this cache may be one cache or multiple caches of varying sizes to suit different needs. The cache may be optimized by prioritizing the cache based on frequency of occurrence. The cache may also be dynamically pruned according to size, performance or other needs.

Embodiments within the scope of the present invention may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those of skill in the art will appreciate that other embodiments of the invention may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

Although the above description may contain specific details, they should not be construed as limiting the claims in any way. Other configurations of the described embodiments of the invention are part of the scope of this invention. For example, in creating computer-based foreign language training, a join cost cache could be used to quickly and efficiently automatically generate foreign speech samples instead of recording actual speech samples from voice actors. Accordingly, the appended claims and their legal equivalents should only define the invention, rather than any specific examples given.

I claim:

1. A method comprising:

extracting, via a processor, at a first time a plurality of phoneme sequences from a text corpus, where a phoneme sequence within the plurality of phoneme sequences occurs at least twice within the text corpus;

identifying joins calculated to synthesize the phoneme sequence to yield identified joins; and storing the identified joins in a cache for use in speech synthesis at a second time that is later than the first time.

2. The method of claim 1, further comprising:

recording a frequency of occurrence for each of the plurality of phoneme sequences; and pruning the cache based on the frequency of occurrence.

3. The method of claim 1, further comprising:

building a plurality of caches of different sizes based on at least one of values and parameters.

4. The method of claim 3, wherein the values and parameters comprise at least one of computational costs and frequency of occurrence.

5. The method of claim 1, further comprising:

optimizing the cache based on frequency of occurrence of the identified joins.

6. The method of claim 2, wherein the cache is pruned using at least one of a static method and a dynamic method.

7. The method of claim 1, further comprising:

recording use instances of each join in the cache.

8. A system comprising:

a processor; and a non-transitory computer-readable memory having stored therein instructions which, when executed by the processor, cause the processor to perform a method comprising:

extracting, at a first time a plurality of phoneme sequences from a text corpus, where a phoneme sequence within the plurality of phoneme sequences occurs more than once within the text corpus;

identifying joins calculated to synthesize the phoneme sequence to yield identified joins;

storing the identified joins in a cache for use in speech synthesis at a second time that is later than the first time; and performing speech synthesis using the identified joins.

9. The system of claim 8, the instructions stored in the non-transitory computer-readable memory further comprising:

recording a frequency of occurrence for each of the plurality of phoneme sequences; and pruning the cache based on the frequency of occurrence.

10. The system of claim 8, the method further comprising:

building a plurality of caches of different sizes based on at least one of values and parameters.

11. The system of claim 8, wherein the values and parameters comprise at least one of computational costs and frequency of occurrence.

12. The system of claim 8, wherein the cache is optimized based on frequency of occurrence of the identified joins.

13. The system of claim 9, wherein the cache is pruned using at least one of a static method and a dynamic method.

14. The system of claim 8, wherein the cache further comprises instances of each join in the identified joins.

15. A non-transitory computer-readable storage medium having stored therein instructions which, when executed by a computing device, cause the computing device to perform steps comprising:

extracting, at a first time, a plurality of phoneme sequences from a text corpus, where a phoneme sequence within the plurality of phoneme sequences occurs more than once within the text corpus;

identifying joins calculated to synthesize the phoneme sequence to yield identified joins; and storing the identified joins in a cache for use in speech synthesis at a second time that is later than the first time.

16. The non-transitory computer-readable storage medium of claim 15, the instructions further comprising:

recording a frequency of occurrence for each of the plurality of phoneme sequences; and pruning the cache based on the frequency of occurrence.

17. The non-transitory computer-readable storage medium of claim 15, the instructions further comprising:

building a plurality of caches of different sizes based on at least one of values and parameters.

18. The non-transitory computer-readable storage medium of claim 15, wherein the values and parameters comprise at least one of computational costs and frequency of occurrence.

19. The non-transitory computer-readable storage medium of claim 15, the instructions further comprising:

optimizing the cache based on frequency of occurrence of the identified joins.

20. The non-transitory computer-readable storage medium of claim 16, wherein the cache is pruned using at least one of a static method and a dynamic method.

* * * * *

UNITED STATES PATENT AND TRADEMARK OFFICE

CERTIFICATE OF CORRECTION

PATENT NO. : 8,214,217 B2
APPLICATION NO. : 13/182082
DATED : July 3, 2012
INVENTOR(S) : Alistair D. Conkie It is certified that error appears in the above-identified patent and that said Letters Patent is hereby corrected as shown below:

In the Claims

Col. 7, Claim 4, line 33, change “the values” to --the at least one of values--

Col. 7, Claim 4, line 34, change “comprise” to --comprises--

Col. 8, Claim 11, line 14, change “the values” to --the at least one of values--

Col. 8, Claim 11, line 15, change “comprise” to --comprises--

Col. 8, Claim 18, line 45, change “the values and parameters comprise” to --the at least one of values and parameters comprise--

Signed and Sealed this
Tenth Day of June, 2014

Michelle K. Lee

Michelle K. Lee
*Deputy Director of the United States Patent and Trademark Office*